US011179743B2

(12) United States Patent
Pidan

(10) Patent No.: US 11,179,743 B2
(45) Date of Patent: Nov. 23, 2021

(54) APPLICATION UNIT

(71) Applicant: Broetje-Automation GmbH, Rastede (DE)

(72) Inventor: Sergej Pidan, Winnenden (DE)

(73) Assignee: Broetje-Automation GmbH, Rastede (DE)

( * ) Notice: Subject to any disclaimer, the term of this patent is extended or adjusted under 35 U.S.C. 154(b) by 0 days.

(21) Appl. No.: 16/466,710

(22) PCT Filed: Oct. 24, 2017

(86) PCT No.: PCT/EP2017/077059
§ 371 (c)(1),
(2) Date: Jun. 5, 2019

(87) PCT Pub. No.: WO2018/103941
PCT Pub. Date: Jun. 14, 2018

(65) Prior Publication Data

US 2019/0299239 A1 Oct. 3, 2019

(30) Foreign Application Priority Data

Dec. 5, 2016 (DE) ..... 10 2016 123 416.8

(51) Int. Cl.
*B05C 5/02* (2006.01)
*B05C 17/005* (2006.01)

(52) U.S. Cl.
CPC ..... *B05C 5/0216* (2013.01); *B05C 5/0204* (2013.01); *B05C 5/0262* (2013.01); *B05C 17/00516* (2013.01)

(58) Field of Classification Search
CPC ... B05C 5/0204; B05C 5/0216; B05C 5/0262; B05C 17/00516
(Continued)

(56) References Cited

U.S. PATENT DOCUMENTS

2016/0271629 A1 9/2016 Pringle, IV et al.
2016/0325307 A1* 11/2016 Atsebha ..... B05C 5/0212

FOREIGN PATENT DOCUMENTS

CN 201067732 6/2008
CN 204247455 4/2015
(Continued)

OTHER PUBLICATIONS

International Preliminary Report on Patentability for PCT Application No. PCT/EP2017/077059 dated Jun. 20, 2019 (10 pages).
(Continued)

*Primary Examiner* — George R Koch
(74) *Attorney, Agent, or Firm* — Pauly, DeVries Smith & Deffner LLC

(57) ABSTRACT

An application unit for applying a viscous material to a component edge, in particular of varying width, of a component, wherein the application unit has a nozzle for applying the viscous material to the component edge, having a discharge opening of adjustable width, and wherein the application unit has a first feeler having a contact surface for contact against the component and a second feeler having a contact surface for contact against the component, wherein the first feeler and the second feeler are pretensionable with a pretensioning arrangement in opposite directions, and wherein the width of the discharge opening is adaptable in dependence on the distance of the contact surface of the first feeler from the contact surface of the second feeler.

22 Claims, 5 Drawing Sheets

(58) Field of Classification Search
USPC ..... 156/578
See application file for complete search history.

(56) References Cited

FOREIGN PATENT DOCUMENTS

| | | |
|---|---|---|
| CN | 205096006 | 3/2016 |
| DE | 102013003688 | 4/2014 |
| DE | 102014110375 | 1/2016 |
| DE | 202016102348 | 6/2016 |
| EP | 0707937 | 4/1996 |
| WO | 2018103941 | 6/2018 |

OTHER PUBLICATIONS

"German Search Report," for German Patent Application No. 102016123416.8 dated Sep. 8, 2017 (7 pages).
"International Search Report and Written Opinion," for PCT Application No. PCT/EP2017/077059 dated Dec. 22, 2017 (13 pages).

* cited by examiner

APPLICATION UNIT

CROSS-REFERENCE TO RELATED APPLICATIONS

This application is a national stage application under 35 U.S.C. 371 of International Patent Application Serial No. PCT/EP2017/077059, entitled "Application Unit," filed Oct. 24, 2017, which claims priority from German Patent Application No. DE 10 2016 123 416.8, filed Dec. 5, 2016, the disclosure of which is incorporated herein by reference.

FIELD OF THE TECHNOLOGY

The disclosure relates to an application unit for applying viscous material to a component edge, in particular of varying width, of a component. The disclosure further relates to an end effector having such an application unit and to a manipulator having such an end effector and/or such an application unit.

BACKGROUND

From the prior art, various application units for viscous materials are known. For instance, in DE 10 2013 003 688 A1 is described an application unit having a combination nozzle which is held by means of a guide roller, during the application of the viscous material, in a defined position relative to the component edge, even if the component edge has a varying width. A drawback with this design is, however, that in the region of the coating of the viscous material, space is required both for the nozzle and for the guide roller, with the result that, with the application unit of DE 10 2013 003 688 A1, viscous material cannot be applied to component edges in the region of narrow cutouts. Added to this is the fact that the nozzle of this application unit requires a continuous air stream for the forming of the viscous material on the component edge, which leads to an increased energy demand and hence to increased operating costs.

SUMMARY

The object is therefore to provide an application unit which is inexpensive to operate and which allows viscous material to be applied to component edges even when there is little space, in particular in the region of narrow component cutouts.

This object is achieved in a constructively particularly simple manner by the application unit according to the disclosure.

Through the provision of an application unit having a nozzle for applying the material to the component edge with a width-adjustable discharge opening, a variable adaptation of the nozzle width to the width of the component edge, and, in particular, also to a varying width of a component edge, is possible.

If the application unit now further has a first feeler having a contact surface for contact against the component and a second feeler having a contact surface for contact against the component, wherein the first feeler and the second feeler are pretensionable in opposite directions with a pretensioning arrangement, a particularly simple, compact and cost-effective guidance of the nozzle relative to the component edge is possible. "Pretensionable in opposite directions" should here be understood to mean that the vectors of the pretensioning force of the feelers at least each have a component which is oriented in the opposite direction.

In order also to be able to adapt the coating to the width of the component edge, it is further provided according to the proposal that the width of the discharge opening is adaptable in dependence on the distance of the contact surface of the first feeler from the contact surface of the second feeler. In this way, an application unit which is especially compact in the region of the discharge opening of the nozzle and is constructively simple and which also enables viscous material to be applied to component edges in the region of narrow component cutouts, can be provided.

In some embodiments, it is proposed that one of the feelers, in particular the first feeler, is fixedly arranged on the nozzle. In some embodiments, if one of the feelers, in particular the first feeler, is configured in one piece (integrally) with the nozzle. As a result, an especially compact design of the nozzle in the region of its discharge opening is enabled.

In various embodiments, it is proposed that one of the feelers, in particular the second feeler, is mounted such that it is movable, in particular linearly displaceable, relative to the nozzle. In particular, a mounting in or on the nozzle has proved to be advantageous. In this way, an adaptation of the nozzle width to the width of the component edge is enabled in a simple manner.

A nozzle which is particularly compact in the region of the discharge opening is able to be realized by virtue of the fact that the nozzle forms with the first feeler and/or the second feeler a nozzle unit, wherein the first feeler and/or the second feeler provides or provide a portion of the discharge opening and, by a movement of one feeler relative to the other feeler, the width of the discharge opening is adaptable. In this case, the feelers, when the viscous material is applied on both sides of the component edge, slide along the component and limit in a simple manner the coating of the viscous material onto the component edge.

Correspondingly, according to various embodiments, it is proposed that the application unit is configured such that the width of the discharge opening is adaptable or adapted, in particular continuously, to the width of the component edge. Here, the width of the discharge opening corresponds substantially, in particular precisely, to the width of the component edge.

According to some embodiments, the discharge opening of the nozzle can be closable by one of the feelers, in particular the second feeler, or the feelers. In some embodiments, the discharge opening of the nozzle is closed by a movement of one of the feelers, in particular the second feeler, relative to the nozzle, or by a movement of the feelers relative to the nozzle, before and/or after the application of the viscous material. In this way, an unwanted dripping of the viscous material from the discharge opening when the application unit is traversed to or from the component edge can be avoided.

In various embodiments, it is provided that the application unit has a receiving unit for receiving the nozzle and/or the nozzle unit. In some embodiments, the nozzle and/or the nozzle unit is detachable from the receiving unit at an interface. In some embodiments, the nozzle and/or the nozzle unit is detachable from the receiving unit without the use of tools. The nozzle or the nozzle unit can hence be configured as a disposable part. A laborious cleaning of the nozzle after the application is no longer necessary. It can be exchanged in a simple and cost-effective manner The operating times of the application unit can be correspondingly increased, since cleaning is dispensed with as a result of the disposal or can be realized separately from the application unit.

According to some embodiments, the pretensioning arrangement can have at least one pretensioning unit, in particular a first pretensioning unit, for pretensioning one of the feelers in a first direction. In some embodiments, the pretensioning arrangement additionally has a second pretensioning unit for pretensioning the other feeler in an opposite direction.

According to some embodiments, the nozzle can be at least partially, predominantly, or completely, made of plastic, in particular polyethylene, and/or the feeler can be, at least partially, predominantly, or completely, made of plastic, in particular polyethylene, and/or the nozzle unit can be at least partially, predominantly, or completely, made of plastic, in particular polyethylene.

Further advantageous embodiments of the application unit can be found in the disclosure.

Furthermore, the object stated in the introduction can be achieved in an end effector. The same advantages are obtained as described above with the application unit.

In a manipulator, the object described in the introduction can be achieved by a manipulator. Here too, the same advantages are obtained as described above in connection with the application unit.

Finally, the object described in the introduction can be achieved according to the process disclosed herein. Here too, the same advantages are obtained as described above in connection with the application unit.

Various embodiments provide an application unit for applying viscous material to a component edge, in particular of varying width and/or position, of a component, wherein the application unit has a nozzle for applying the viscous material to the component edge, having a discharge opening of adjustable width, and wherein the application unit has a first feeler having a contact surface for contact against the component and a second feeler having a contact surface for contact against the component, wherein the first feeler and the second feeler are pretensionable with a pretensioning arrangement in opposite directions, and wherein the width of the discharge opening is adaptable in dependence on the distance of the contact surface of the first feeler from the contact surface of the second feeler.

In various embodiments, one of the feelers, in particular the first feeler, is fixedly arranged on the nozzle, wherein one of the feelers, in particular the first feeler, is configured in one piece with the nozzle.

In various embodiments, one of the feelers, in particular the second feeler, is mounted such that it is movable, in particular linearly displaceable, relative to the nozzle, wherein one of the feelers, in particular the second feeler, is mounted in or on the nozzle such that it is movable, in particular linearly displaceable, relative thereto.

In various embodiments, the nozzle forms with the first feeler and/or the second feeler a nozzle unit, wherein the first feeler and/or the second feeler provides or provide a portion of the discharge opening and, by a movement of one feeler relative to the other feeler, the width of the discharge opening is adaptable.

In various embodiments, the application unit is configured such that the width of the discharge opening is adaptable or adapted, in particular continuously, to the width of the component edge.

In various embodiments, the discharge opening of the nozzle is closable by one of the feelers, in particular the second feeler, or the feelers, wherein the discharge opening of the nozzle is closed by a movement of one of the feelers, in particular the second feeler, or of the feelers, relative to the nozzle before and/or after the application of the viscous material.

In various embodiments, the application unit has a receiving unit for receiving the nozzle and/or the nozzle unit, wherein the nozzle and/or the nozzle unit is detachable from the receiving unit at an interface, wherein the nozzle and/or the nozzle unit is detachable from the receiving unit without the use of tools.

In various embodiments, the pretensioning arrangement has at least one, in particular a first, pretensioning unit for pretensioning one of the feelers in a first direction, wherein the pretensioning arrangement has a second pretensioning unit for pretensioning the other feeler in an opposite direction.

In various embodiments, the first pretensioning unit is a component part of the receiving unit and/or is arranged on the nozzle, and/or wherein the second pretensioning unit is a component part of the receiving unit and/or is arranged on the nozzle.

In various embodiments, the first pretensioning unit has, for generation of the pretensioning force, a spring element, in particular a pneumatic spring element and/or a spiral-coiled spring element and/or a leaf spring element, and/or wherein the second pretensioning unit has, for generation of the pretensioning force, a spring element, in particular a pneumatic spring element and/or a spiral-coiled spring element and/or a leaf spring element.

In various embodiments, the nozzle is at least partially, predominantly, or completely, made of plastic, in particular polyethylene, and/or wherein the second feeler is at least partially, predominantly, or completely, made of plastic, in particular polyethylene, and/or wherein the nozzle unit is at least partially, predominantly, or completely, made of plastic, in particular polyethylene.

In various embodiments, the nozzle has a scraping element, in particular connected in one piece to the nozzle, for spreading the material applied to the component edge.

In various embodiments, the discharge opening points at an angle to the longitudinal extent of the nozzle, wherein the discharge opening points in a direction orthogonally to the longitudinal extent of the nozzle.

Various embodiments provide an end effector having an application unit as described herein.

Various embodiments provide a manipulator having an end effector and/or an application unit as described herein.

Various embodiments provide a process for applying viscous material to a component edge, in particular of varying width and/or position, of a component, in particular having an application unit as described herein, wherein, during the application of the viscous material by means of a nozzle, a feeler is pretensioned toward the component and, by means of the feeler, the width of a discharge opening of the nozzle is adapted to the width of the component edge.

BRIEF DESCRIPTION OF THE DRAWINGS

The disclosure is explained in greater detail below with reference to a drawing representing just one illustrative embodiment. In the drawing.

DETAILED DESCRIPTION

Figure 1:
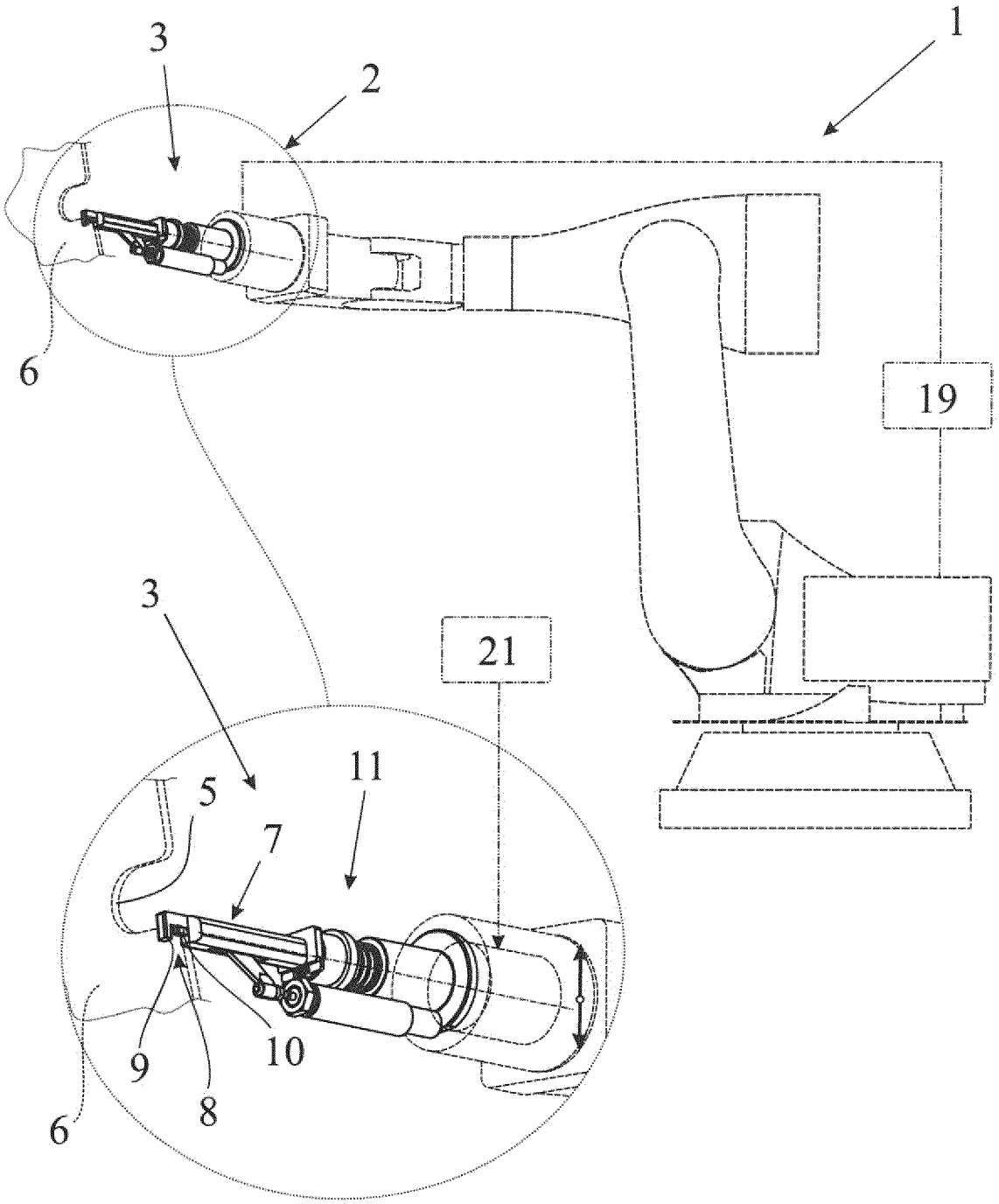
FIG. 1 shows an application unit according to the proposal having an end effector according to the proposal on a manipulator according to the proposal, FIG. 2*a*) shows the application unit according to the proposal during the application of the viscous material to a component edge, and *b*) the application unit according to the proposal with a nozzle unit detached from the receiving unit.

In FIG. 1, a manipulator 1 according to the proposal, having an end effector 2 according to the proposal and an application unit 3 according to the proposal, is shown. The manipulator 1 can in particular be an industrial robot having at least three axes or at least four axes, or a gantry robot having at least three axes or at least four axes. The manipulator 1 shown in FIG. 1 has six axes.

The application unit 3 serves to apply a viscous material 4 to a component edge 5, in particular of varying width $B_K$ and/or position, of a component 6. Such a component edge is shown in FIG. 2*a*. The component edge 5 is here an end face of the component 6, in particular an end face of a plate-like portion of the component 6. The width $B_K$ of the component edge 5 is constituted by the width transversely to the running direction VB of the component edge 5.

Figure 3:
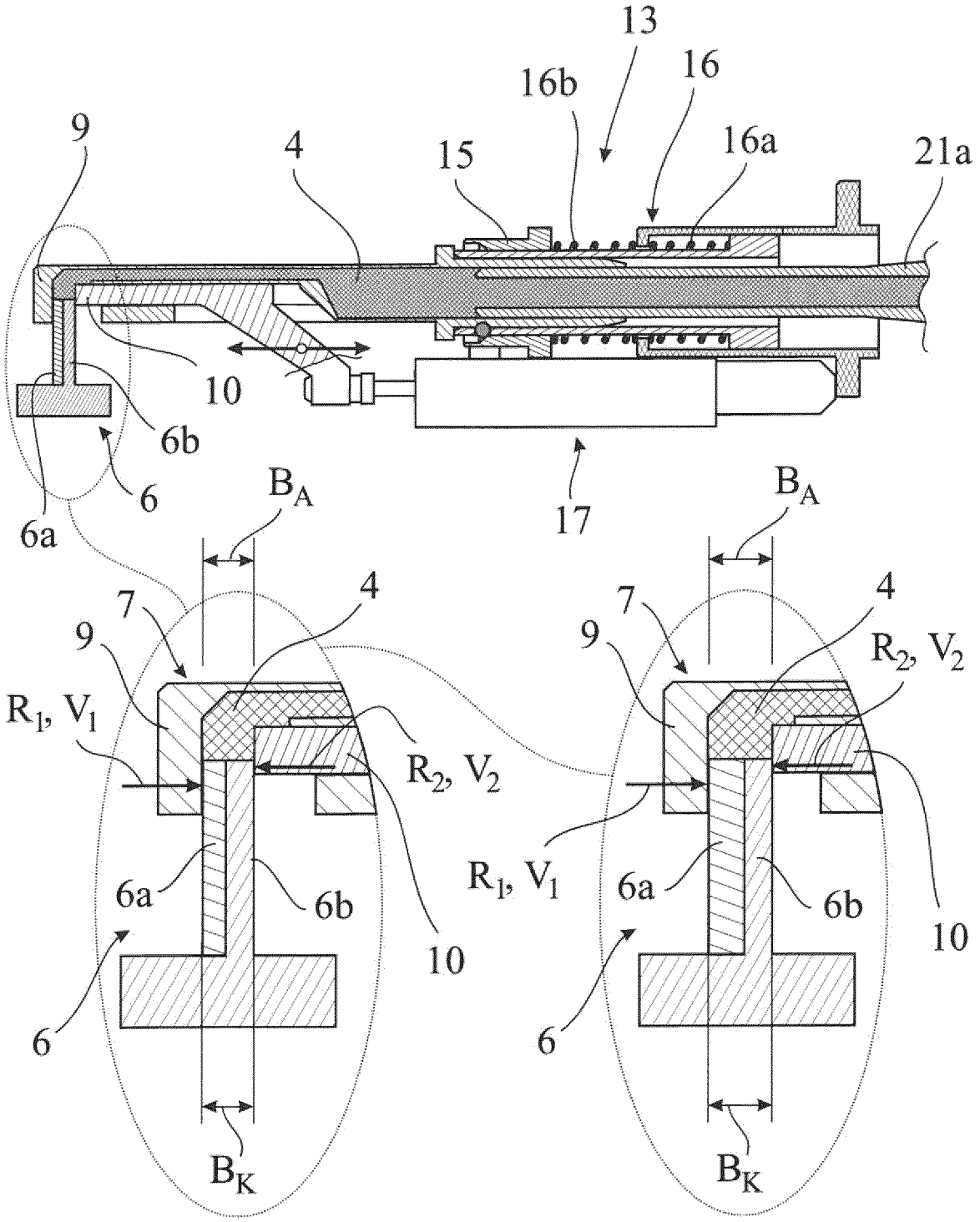
FIG. 3 shows the application unit according to the proposal in a sectional representation in the longitudinal section according to III in FIG. 2.

In some embodiments, the component 5 is a structural component, in particular a motor vehicle structural component and/or an aircraft structural component, for instance a stringer. The component 5 can in particular also be constituted by an assembly of various parts 6*a*, 6*b*, as is shown in FIG. 3. In particular, the component 5 can be a composite component, such as a composite component made of carbon-fiber-reinforced plastic (CFRP) and/or a composite component made of glass-fiber-reinforced aluminum, so-called glare.

The viscous material 4 can in particular be an adhesive and/or a sealing material. In some embodiments, the viscous material is a two-component epoxide. This can be mixed prior to the discharge from the discharge opening 8. As is the case in the illustrative embodiment, it can here be mixed prior to entry into the application unit 3. Alternatively, it can, however, also be mixed in the application unit, in particular in the nozzle 7, or upon entry into the application unit 3, in particular into the nozzle 7.

According to the proposal, the application unit 3 has a nozzle 7 for applying the material to the component edge 5, having a discharge opening 8 of adjustable width $B_A$.

The discharge opening 8 is here configured at an angle to the longitudinal extent of the nozzle 7. In some embodiments, the discharge opening 8, as represented in the illustrative embodiment, is arranged in a direction orthogonally to the longitudinal extent L of the nozzle 7. As a result, component edges 5 of narrow recesses can be flexibly sealed in a simple manner In principle, according to an alternative illustrative embodiment, it is also conceivable, however, that the discharge opening 8 points in the direction of the longitudinal extent L of the nozzle 7.

According to the proposal, the application unit 3 further has a first feeler 9 having a contact surface 9a for contact against the component 6, in particular against a first side, adjoining the component edge 5, of the component 6, and a second feeler 10 having a contact surface 10*a* for contact against the component 6, in particular against a second side, adjoining the component edge 5 and lying opposite the first side.

The first feeler 9 and the second feeler 10 are pretensionable with a pretensioning arrangement 11 in opposite directions onto the component 6. The width $B_A$ of the discharge opening 8 can now be adapted in dependence on the distance between the contact surface 9*a* of the first feeler 9 and the contact surface 10*a* of the second feeler 10. As a result, a particularly simple energy-saving application to the component edge 5 is possible. Furthermore, this also enables a particularly compact design of the nozzle 7 in the region of the discharge opening 8, with the result that the viscous material 4 can also be applied to the component edges 5 of narrow cutouts. Moreover, a constructively simple, and hence cost-effective design, is enabled.

By "pretensionable in opposite directions" should here be understood that the vectors $V_1$, $V_2$ of the pretensioning force of the feelers 9, 10 at least each have a component which is oriented in the opposite direction. In some embodiments, the vectors $V_1$, $V_2$ of the pretensioning force are arranged parallel to the width direction of the nozzle 7.

Figure 2:
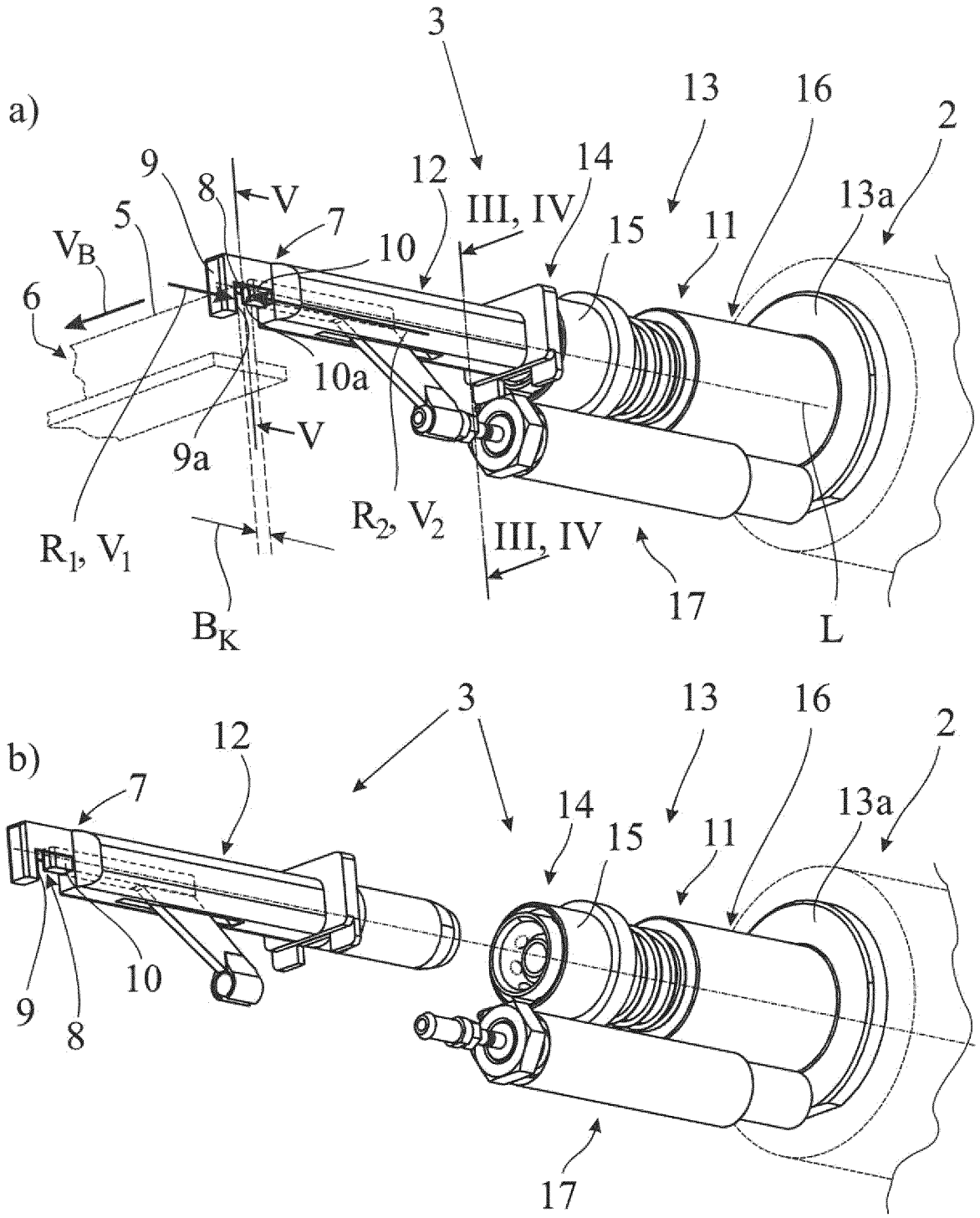

The contact surfaces 9*a*, 10*a* of the two feelers 9, 10 here lie, as shown in FIG. 2 shown, opposite one another. Correspondingly, the two feelers 9, 10 are here also able to be mutually pretensioned.

As shown in the sectional representation of FIG. 3, one of the feelers 9 can be fixedly arranged on the nozzle 7. Here the feeler 9 is configured in one piece (integrally) with the nozzle 7. It forms a tactile portion of the nozzle 7. Alternatively, the feeler 9 can also have a roller, which can facilitate sliding of the feeler 9 along the component 6 during the application of the viscous material 4.

The second feeler 10 is mounted such that it is movable relative to the nozzle 7. Here, the second feeler 10 is mounted such that it is linearly displaceable in the nozzle 7. An alternative design provides that the second feeler 10 is mounted such that it is movable, in particular linearly displaceable, on the nozzle 7.

Here, the second feeler 10 is configured as a sliding block, which is translatorily movable. Alternatively, the feeler 10 can, however, also have a roller, which facilitates sliding of the feeler 10 along the component 6 during the application of the viscous material 4.

In an alternative illustrative embodiment, both feelers 9, 10 can be mounted such that they are movable, in particular linearly displaceable, relative to the nozzle 7. In some embodiments, these are then mounted in or on the nozzle 7, and/or are both configured such as previously described for the second feeler 10.

In the illustrative embodiment, the nozzle 7 forms with the first feeler 9 and/or the second feeler 10 a nozzle unit 12. Here, it is the case that the first feeler 9 and the second feeler 10 each provide a portion of the discharge opening 8. The width $B_A$ of the discharge opening 8 can thus be adapted by a movement of one feeler 9, 10 relative to the other feeler 9, 10, such as is shown in FIG. 3 in the enlargements.

Here the nozzle unit 12 has a receiving region 13 for receiving the component edge 5 of the component 6 during the application of the viscous material 4 to the component edge 5. Said receiving region is here delimited by the first feeler 9 and the second feeler 10, during the application of the viscous material 4 to the component edge 8, in the width direction of the discharge opening 8.

The application unit 3 is here configured such that the width $B_A$ of the discharge opening 8 is adaptable, in particular continuously, to the width $B_K$ of the component edge 5, or can be adapted during the application. Here, the adaptation is realized passively, thus without the purposeful activation of an actuator for adjustment of the change.

In addition to the nozzle unit 12, the application unit 3 has a receiving unit 13 for receiving the nozzle unit 12. As shown in FIG. 2*b*, the nozzle unit 12 is detachable from the receiving unit 13 at an interface 14. In the illustrative embodiment, the nozzle unit 12 can be detached from the receiving unit 13 without the use of tools. The interface 14 is here designed as a quick-release fastener and can be easily removed from a locking mechanism on the receiving unit 13 by the movement of a sleeve 15, in particular counter to a spring pretension. It should here be noted that the nozzle 7, once this is received in locked arrangement by the receiving unit 13, is fixedly connected thereto.

In order to generate the pretension, the pretensioning arrangement 11 has at least one, in particular a first, pretensioning unit 16 for pretensioning one of the feelers 9 in a first direction $R_1$.

The first pretensioning unit 16 is here arranged on the receiving unit 13. It here acts between a mounting flange 13*a*, for fastening the application unit 3 to the manipulator 1, and the nozzle 7. Alternatively, it can, however, also be arranged on the nozzle 7. In the illustrative embodiment, it has a spiral-coiled spring element 16*a* as the spring element. Alternatively, the first pretensioning unit 16 can, however, also have a pneumatic spring element and/or a leaf spring element. In addition, the first pretensioning unit 16 can have a further spring element, in particular a spring element which is configured as a spiral-coiled spring element 16*b* and which is pretensioned against the spring element 16*a* of the first pretensioning unit 16. This spring element 16*b* can at the same time pretension the sleeve 15 into its locking position.

The pretension of the first feeler 9 is generated by means of the first pretensioning unit 16. To this end, the component edge 5 is approached with the nozzle 7, and subsequently the first feeler 9 is pretensioned against the component 6, in that, by a manipulator movement in the direction of the second feeler 10, the first pretensioning unit 16 is tensioned and the first feeler 9 is pretensioned toward the component 5.

In the illustrative embodiment, the pretensioning arrangement 16 further has a second pretensioning unit 17 for pretensioning the other feeler 10 in the opposite direction $R_2$. For the definition of the opposite directions, reference may be made to the above explanations. Here, it is the case, however, that the directions are arranged parallel to the width direction of the discharge opening 8.

The second pretensioning unit 17 too is here arranged on the receiving unit 13. It here acts between the mounting flange 13*a* and the second feeler 10. Alternatively, the second pretensioning unit 17 can, however, also be arranged on the nozzle 7. For the generation of the pretensioning force, it likewise has a spring element. This is in the illustrative embodiment a pneumatic spring element, here in the form of a pneumatic cylinder. By means of the pneumatic cylinder, the pretensioning of the second feeler 10 can be activated or deactivated. As a result of the activation, the component edge 5, as shown in FIG. 3, is able to be wedged between the two feelers 9, 10.

The pretensioning units 16, 17 serve both to compensate tolerances of the component 6 along the component edge 5, thus the varying position of the component edge, and to compensate changes in the width $B_K$ of the component edge 5.

The nozzle 7 and the feelers 9, 10 are here made of plastic, in particular polyethylene. A plastics configuration of the nozzle unit 12 enables a particularly cost-effective production. This offers considerable cost benefits, in particular when the nozzle unit 12 is configured as an exchangeable and/or disposable part. This is particularly advantageous when the nozzle 7 is configured as a disposable part, since this enables a cost-effective production of the same.

Figure 5:
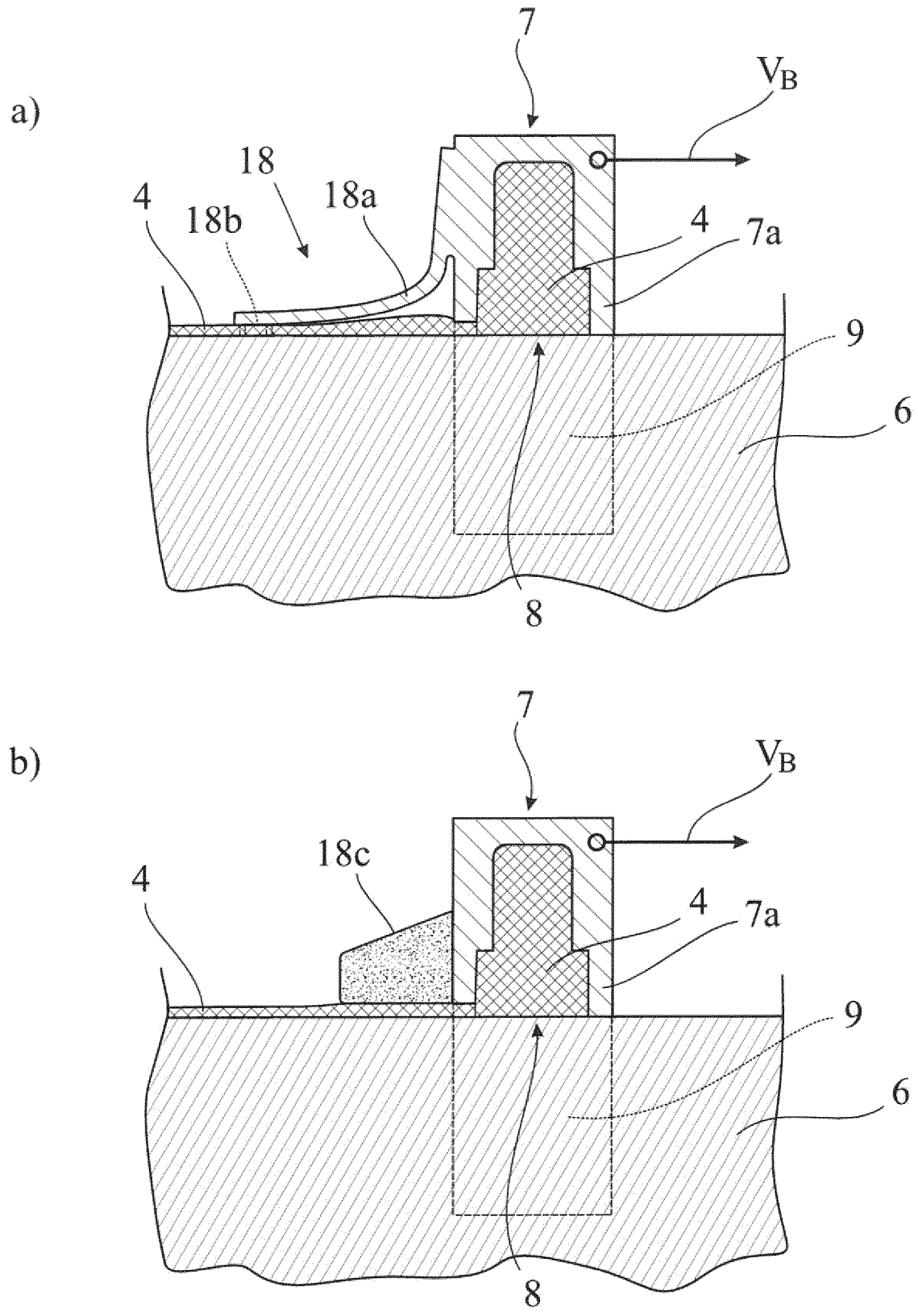

As shown in FIG. 5, the nozzle 7 can have a supporting element 7*a*, here as a front boundary of the discharge opening 8, which runs ahead of the discharge opening 8 during the application of the viscous material 4. Via this supporting element, the nozzle 7, in particular by the manipulator 1, can be pretensioned toward the component edge 5 in a direction orthogonally to the face thereof.

Figure 4:
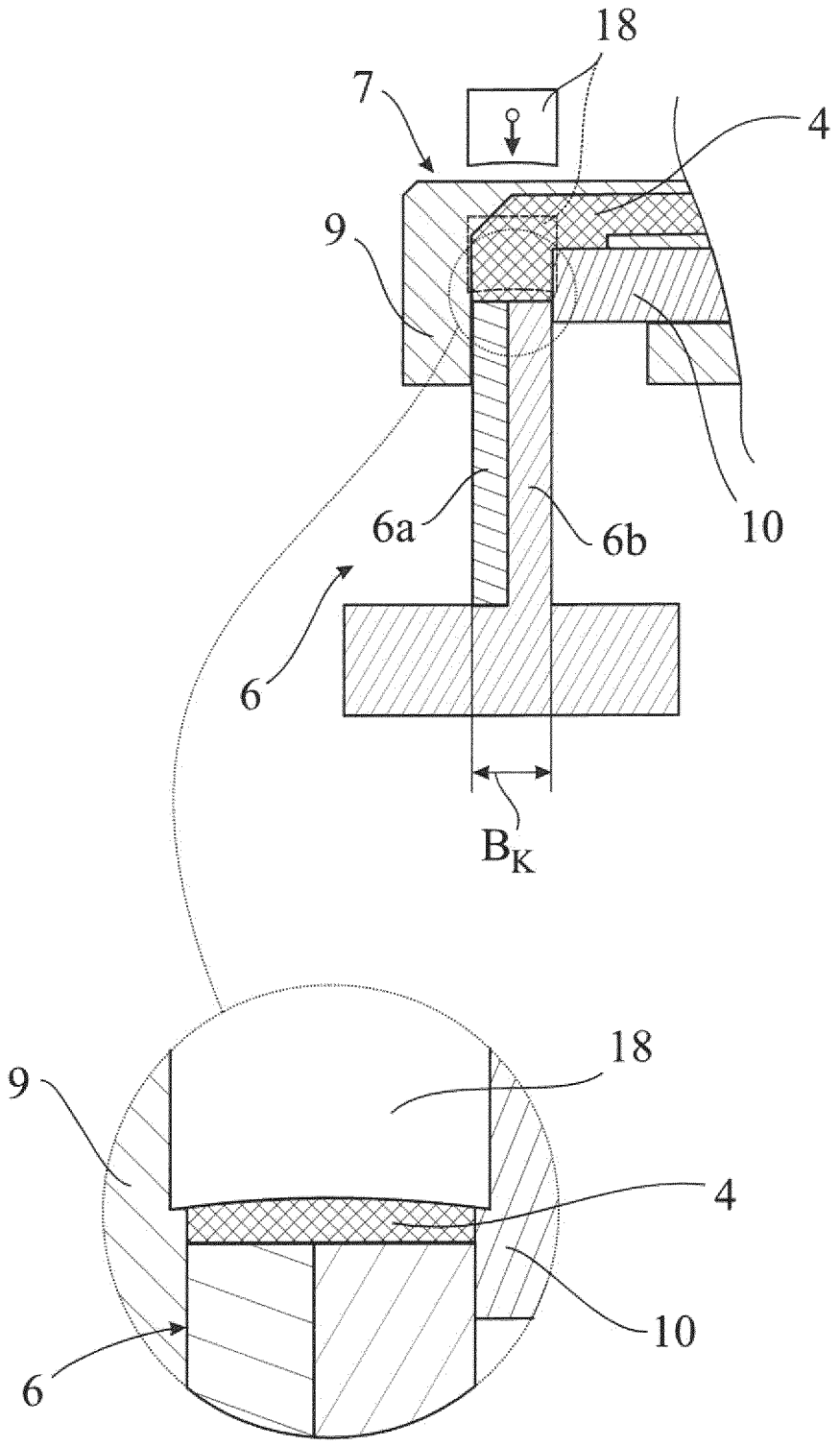
FIG. 4 shows the nozzle in a sectional representation in the longitudinal section according to IV in FIG. 2, in a first embodiment having a first scraping element for scraping the viscous material on the component edge, and FIG. 5*a*) shows the nozzle in a sectional representation in the cross section according to V in FIG. 2, in an embodiment having a lip as the scraping element, and *b*) shows the nozzle in a sectional representation in the cross section according to V in FIG. 2, in an embodiment having a sponge-like pad as the scraping element.

Trailing the discharge opening 18, a scraping element 18 for spreading the material 4 applied to the component edge 5 is here provided, as is shown in FIGS. 5*a*) and 5*b*). The scraping element 18 here forms a further boundary of the discharge opening 8. The scraping element 18 can be connected in one piece to the nozzle 7, or it can be detachably fastened to the nozzle 7, so that it can also be exchanged for a scraping element 18 of different type. This is represented in FIG. 4. The shape and/or thickness of the applied seam can be influenced by different scraping elements 18. This is possible both through the design of the shape of a scraping contour of the scraping element 18 and through the design of the scraping element 18 itself.

The scraping element 18 can be configured as an, in particular flexible, lip 18*a*, as is shown in FIG. 5*a*. This lip can have on its coating edge sliding contours 18*b* and/or bristles. Alternatively, the scraping element 18 can be configured as an, in particular sponge-like, pad 18*c*, as is shown in FIG. 5*b*. during the application of the viscous material 4, a sponge-like pad 18*c* slides, such as full-facedly, on the component edge 5 or on the viscous material 4 applied thereto.

In various embodiments, the scraping element 18 has sliding contours 18*b*, which, during the scraping, generate gases in the seam of viscous material 4, which gases peter out again prior to the hardening of the viscous material 4. With the different scraping elements 18, different seam shapes are able to be produced.

The end effector 2 can further have, as shown in FIG. 1, a cartridge holder 20 for receiving a cartridge 21 containing the viscous material 4. In some embodiments, the cartridge holder 20 receives a cartridge 21 having a cartridge nozzle 21*a*. The cartridge nozzle 21*a* here opens out into the nozzle 7 of the application unit 3, as shown in FIG. 3.

Moreover, a control system 19 for controlling the end effector 2 can be provided. In some embodiments, the control system 19 of the end effector 3 is integrated in the control system of the manipulator 1. By means of the control system 19, the manipulator 1 having the end effector 2 with the application unit 3 according to the proposal is controlled during the process for applying the viscous material 4.

For the application of the viscous material 4 to the component edge 5, the latter is approached with the nozzle 7. The nozzle 7 is here pretensioned toward the component edge 5, here in the discharge direction of the viscous material 4. The feelers 9, 10 are then pretensioned toward the component 6. Here, the first feeler 9 is moved transversely to the component edge 5 and thus pretensioned against the component 6, in the width direction of the discharge opening 8. The second feeler 10 is pretensioned, by activation of the second pretensioning unit 17, against the component 6. The pneumatic spring element presses the second feeler 10 against the component 6. The viscous material 4 is applied by guidance of the nozzle 7 along the component edge 5. If the component edge 5 changes its width $B_K$, the width $B_A$ of the discharge opening 8 of the nozzle 7 is adapted by means of the feelers 9, 10 to the width $B_K$ of the component edge 5.

The invention claimed is:

1. An application unit for applying viscous material to a component edge, of a component, wherein the application unit has a nozzle for applying the viscous material to the component edge, having a discharge opening of adjustable width, wherein the application unit has a first feeler having a contact surface for contact against the component and a second feeler having a contact surface for contact against the component, wherein the first feeler and the second feeler are pretensionable with a pretensioning arrangement in opposite directions, wherein the application unit has a receiving unit for receiving the nozzle and/or a nozzle unit, wherein the nozzle and/or the nozzle unit is detachable from the receiving unit at an interface, wherein the pretensioning arrangement has at least a first pretensioning unit for pretensioning the first feeler in a first direction, and a second pretensioning unit for pretensioning the second feeler in an opposite direction, and wherein the first pretensioning unit is a part of the receiving unit and the second pretensioning unit is a part of the receiving unit.

2. The application unit as claimed in claim 1, wherein one of the feelers is fixedly arranged on the nozzle.

3. The application unit as claimed in claim 2, wherein one of the feelers is configured in one piece with the nozzle.

4. The application unit as claimed in claim 1, wherein one of the feelers is mounted such that it is movable relative to the nozzle.

5. The application unit as claimed in claim 4, wherein one of the feelers is mounted in or on the nozzle such that it is movable relative thereto.

6. The application unit as claimed in claim 1, wherein the nozzle forms with the first feeler and/or the second feeler the nozzle unit.

7. The application unit as claimed in claim 6, wherein the first feeler and/or the second feeler provides or provide a portion of the discharge opening and, by a movement of one feeler relative to the other feeler, the width of the discharge opening is adaptable.

8. The application unit as claimed in claim 1, wherein the application unit is configured such that the width of the discharge opening is adaptable or adapted to the width of the component edge.

9. The application unit as claimed in claim 1, wherein the discharge opening of the nozzle is closable by one of the feelers.

10. The application unit as claimed in claim 9, wherein the discharge opening of the nozzle is closed by a movement of one of the feelers relative to the nozzle before and/or after the application of the viscous material.

11. The application unit as claimed in claim 1, wherein the first pretensioning unit has, for generation of the pretensioning force, a spring element and/or wherein the second pretensioning unit has, for generation of the pretensioning force, a spring element.

12. The application unit as claimed in claim 11, wherein the spring element of the first pretensioning unit is a pneumatic spring element and/or a spiral-coiled spring element and/or a leaf spring element.

13. The application unit as claimed in claim 11, wherein the spring element of the second pretensioning unit is a pneumatic spring element and/or a spiral-coiled spring element and/or a leaf spring element.

14. The application unit as claimed in claim 1, wherein the nozzle is at least partially made of plastic and/or wherein the second feeler is at least partially made of plastic, and/or wherein the nozzle unit is at least partially made of plastic.

15. The application unit as claimed in claim 1, wherein the nozzle has a scraping element.

16. The application unit as claimed in claim 15, wherein the scraping element is connected in one piece to the nozzle, for spreading the material applied to the component edge.

17. The application unit as claimed in claim 1, wherein the discharge opening points at an angle to the longitudinal extent of the nozzle, wherein the discharge opening points in a direction orthogonally to the longitudinal extent of the nozzle.

18. An end effector having an application unit as claimed in claim 1.

19. A manipulator having an end effector as claimed in claim 18.

20. A process for applying viscous material to a component edge of a component, having an application unit as claimed in claim 1, wherein, during the application of the viscous material by the nozzle, the first and second feelers are pretensioned toward the component and, by the first and second feelers, the width of the discharge opening of the nozzle is adapted to the width of the component edge.

21. The process of claim 20, wherein the component edge is of varying width and/or position.

22. The application unit as claimed in claim 1, wherein the component edge is of varying width and/or position.

* * * * *